US006043785A

United States Patent [19]

Marino

[11] Patent Number: 6,043,785

[45] Date of Patent: Mar. 28, 2000

[54] BROADBAND FIXED-RADIUS SLOT ANTENNA ARRANGEMENT

[75] Inventor: Ronald A. Marino, Burlington, N.J.

[73] Assignee: Radio Frequency Systems, Inc., Marlboro, N.J.

[21] Appl. No.: 09/201,692

[22] Filed: Nov. 30, 1998

[51] Int. Cl.[7] ..... H01Q 13/10

[52] U.S. Cl. ..... 343/767; 343/700 MS; 343/770

[58] Field of Search ..... 343/767, 770, 343/700 MS, 807; H01Q 13/10

[56] References Cited

U.S. PATENT DOCUMENTS

| | | | |
|---|---|---|---|
| 4,855,749 | 8/1989 | DeFonzo | 343/767 |
| 5,023,623 | 6/1991 | Kreinheder et al. | 343/770 |
| 5,036,335 | 7/1991 | Jairam | 343/767 |
| 5,227,808 | 7/1993 | Davis | 343/767 |
| 5,428,364 | 6/1995 | Lee et al. | 343/767 |
| 5,519,408 | 5/1996 | Schnetzer | 343/767 |
| 5,841,405 | 11/1998 | Lee et al. | 343/767 |

*Primary Examiner*—Don Wong
*Assistant Examiner*—Hoang Nguyen
*Attorney, Agent, or Firm*—Ware, Fressola, Van Der Sluys & Adolphson LLP

[57] ABSTRACT

A fixed radius tapered slot antenna (100) formed a dielectric substrate (10) with an electrically conductive layer (14) on one side. The slot is defined by two hemispherical shaped elements (12, 13). A common base (15) is also formed on the conductive layer behind the hemispherical shaped members. Preferably, a microstrip feedline (16) is formed on the side of the dielectric substrate to electromagnetically couple to the balun (18) adjacent the narrow end of the tapered slot. A contiguous array (102) of fixed radius tapered slot antennas (100) can be made on the same conductive layer of a dielectric layer. A reflector (30) can be integrated with the antenna array to improve the radiation pattern. The fixed radius tapered slot antenna has been proven to out-perform an exponentially tapered slot or Vivaldi antenna.

15 Claims, 8 Drawing Sheets

BROADBAND FIXED-RADIUS SLOT ANTENNA ARRANGEMENT

FIELD OF THE INVENTION

This invention relates to an antenna with broadband operating characteristics for use in cellular (824–940 MHz), PCS (1850–1990 MHz) frequency bands as well as other frequency bands and, in particular, to an antenna arrangement comprising an array of tapered slot antenna elements and a balun for coupling a feedline with each antenna element.

BACKGROUND OF THE INVENTION

Tapered slot antennas have been in use extensively as linear polarized radiators. In most applications, linearly tapered slot antennas or exponentially tapered slot antennas, commonly known as notch antennas or Vivaldi antennas, are used. Linear slot antennas have been disclosed in U.S. Pat. No. 4,855,749 (DeFonzo); exponentially tapered slot antennas have been disclosed in U.S. Pat. No. 5,036,335 (Jairam) and U.S. Pat. No. 5,519,408 (Schnetzer). In particular, DeFonzo discloses the design of an opto-electronic tapered slot transceiver, made on a silicon on sapphire substrate wherein the slotline can be linearly or exponentially tapered. Jairam discloses an improved balun for electromagnetically coupling the slotline with a feedline in a Vivaldi antenna. The return loss of the improved balun significantly out performs that of a conventional feed in which a straight length of the slotline is coupled to a straight length of a feedline at right angles, separated by a dielectric layer. The conventional Vivaldi antenna with conventional feed is shown in FIG. 1. As shown in FIG. 1, the Vivaldi antenna 2 is an exponentially tapered slot formed on a dielectric substrate 4, defined by two opposite members 6, 7 of a metallized layer 5 on one side of the substrate. The feedline 1 is a narrow conductor located on the other side of the substrate, crossing over the extended portion 3 of the slotline at right angles, forming a balun D. For comparison, the return loss patterns of an exponentially tapered slot antenna with conventional feed (dotted line) and that with Jairam's improved feed (solid line) are shown in FIG. 2. Schnetzer discloses a Vivaldi slot antenna fed by a section of a slotline and a coplanar waveguide. Schnetzer also discloses an array of Vivaldi antennas being incorporated on a thin substrate having thereon a copper conductor layer and each antenna is fed from a coplanar waveguide feed network. The major disadvantage of the Vivaldi configuration is that the return loss performance does not meet the requirements of today's broadband communication applications.

In recent years, there has been a tremendous demand on broadband antenna arrays to be used in cellular telephones or communication devices operated in PCS frequencies. Other applications such as interferometer array for direction finding and early warning RADAR also require broadband operations. Thus, it is advantageous to provide a coplanar antenna array with broadband capability for operations over multiple frequency bandwidths.

SUMMARY OF THE INVENTION

It is an objective of the present invention to provide an antenna arrangement with a narrow profile having a broadband capability enabling operations over multiple frequency bandwidths.

It is another objective of the present invention to provide an antenna arrangement which can be produced, along with its microstrip feed network, on a single piece of thin dielectric substrate thereby reducing mass production cost and product weight.

It is yet another objective of the present invention to provide an antenna arrangement with a convenient ground plane for the microstrip feed network without having plated through holes and special grounding provision.

It is a further objective of the present invention to provide an antenna arrangement wherein the systems performance can be optimized using available antenna modeling computer programs thereby shortening the product development time.

The antenna arrangement in accordance with the present invention utilizes a broadband tapered slot antenna which is fabricated from an electrically conducting layer on an insulating substrate. In order to improve the broadband capability of the slot antenna, the tapered slot is designed to have a fixed-radius of curvature along the boundaries of the slot. Furthermore, with a dielectric substrate having a metallized layer on each of its two surfaces, a large number of coplanar fixed-radius elements can be etched out from one metallized layer to form a contiguous array of tapered slot antennas. On the opposite side of the substrate, a microstrip feed network having a number of feedlines can be etched out on the metallized layer to form a power divider network having a matrix of baluns, electromagnetically coupling each tapered slot to a feedline. Due to its broadband nature, the fixed-radius tapered slot antenna is less susceptible to minor variances of substrate dielectric as compared to antennas without broadband performance. This means that fixed-radius tapered slot antennas can be fabricated on regular PC circuit boards without significantly degrading the return loss performance.

The antenna array can be further integrated with a metallized reflector for adjusting the radiation patterns. The antenna arrangement may also have a radome for enclosing the antenna array and the reflector.

The objectives of the present invention will become apparent upon reading the following description, taken in conjunction with accompanying drawings, in which like reference characters and numerals refer the like parts throughout.

DETAILED DESCRIPTION OF THE INVENTION

Figure 1:
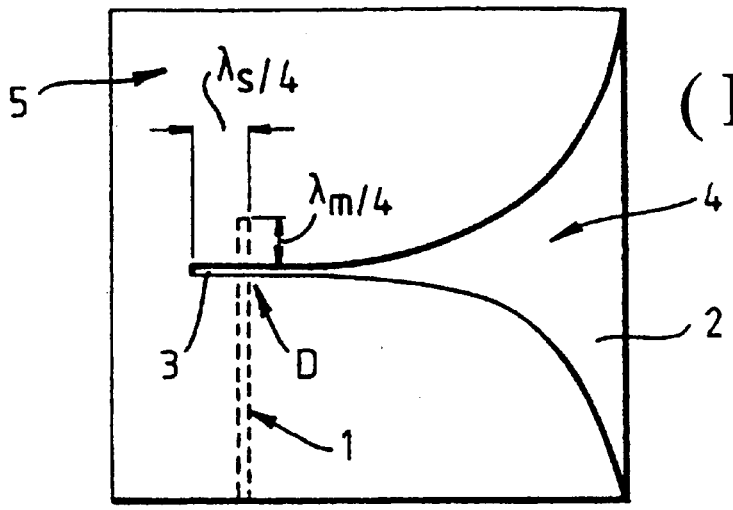
FIG. 1 ( PRIOR ART)
FIG. 1 illustrates a prior art tapered slot antenna with conventional feed.
Figure 3:
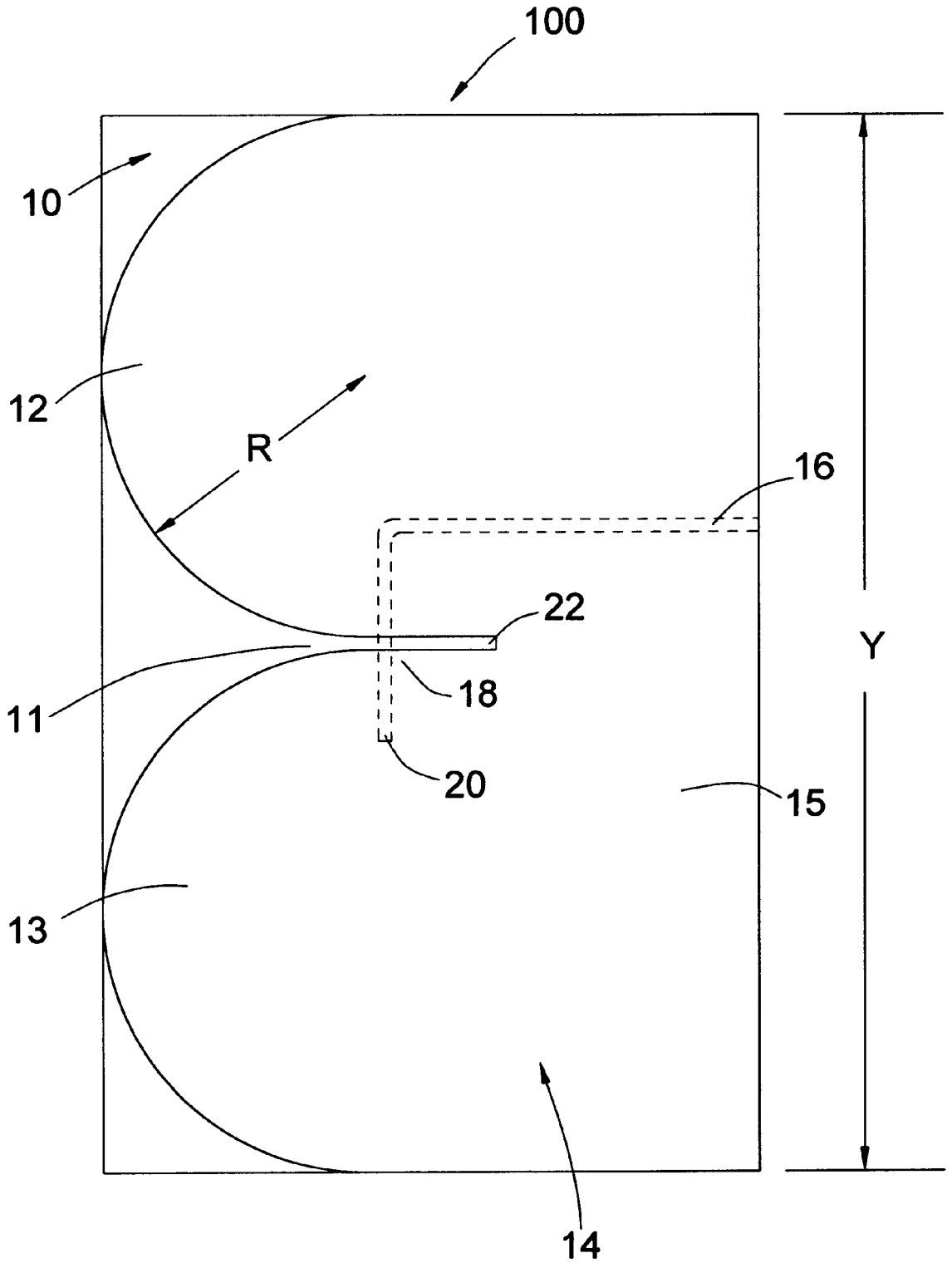
FIG. 3 illustrates a fixed-radius tapered slot antenna, according to the present invention, having a conventional microstrip feed.

Referring now to FIG. 3, there is shown a drawing of a fixed-radius tapered slot antenna 100 produced on a surface of a dielectric substrate 10. In FIG. 3, slot antenna 11 is defined by the gap between two hemispherical shaped members 12, 13 formed on the metallized layer 14 on one side of the dielectric substrate. In contrast to the conventional Vivaldi antenna (as shown in FIG. 1) in which the radius of curvature of the electrically conductive members defining the tapered slot increases as the slot becomes progressively narrow, the radius, R, of the electrically conductive members 12, 13 is fixed. On the other side of the dielectric substrate, a conventional microstrip feedline 16 is provided. The dielectric gap around the cross-over point 18 of the slot antenna 11 and the feedline 16 may be viewed as a balun 18 or a microstrip to slotline transition. The feedline section 20 extended beyond the balun 18 is commonly referred to as a microstrip shunt, while the slot section 22 extended beyond the balun is referred to as a slotline shunt. In order to define the slotline shunt and to provide the ground plane for the microstrip feedline 16, an extended portion 15 of the metallized layer is also provided.

As shown the length of the antenna element is Y. The low-end frequency return loss performance, in general, is a function of the size of the tapered slot and the lowest operating frequency is related to the length Y. In particular, in one of the preferred embodiments of the present invention, the radius R of the hemispherical members is chosen to be about one eighth of the wavelength of the lowest operating frequency (for convenience, this wavelength is hereafter referred to as the longest operating wavelength.) Thus, the length Y of the antenna shown in FIG. 3 is approximately equal to one half of the longest operating wavelength. It should be noted, however, that the radius of hemispheres can be smaller or greater than one eighth of the longest operating wavelength. In the tapered slot antenna, the high-order mode propagation and thus the high-end frequency performance of the antenna, is a function of the thickness of the dielectric substrate. The propagation of the unwanted higher order modes could degrade the performance of both the return loss and the radiation patterns of the antenna. Because the unwanted higher order modes may reach their cutoff at high operating frequencies, it is advantageous to produce a slot antenna on a thin substrate.

In one of the embodiments of the present invention, the impedance of the slotline 11 for optimal performance has been determined, through experimentation and modeling, to be approximately 72 ohms. By adjusting the dimensions of the slotline shunt 22 and those of the microstrip shunt 20, the return loss can be fine-tuned for narrow bandwidths. However, the dimensions and the shape of slotline shunt and the microstrip shunt may be changed to meet systems requirements. For example, the shunt can be as short as one hundredth of the operating wavelength or as long as a quarter wavelength or longer, and the balun can be designed differently. The impedance of the slotline 11 can vary from 50 to 100 ohms. It can also be greater or smaller, but an impedance of 70 to 80 ohms is usually preferred.

Figure 6:
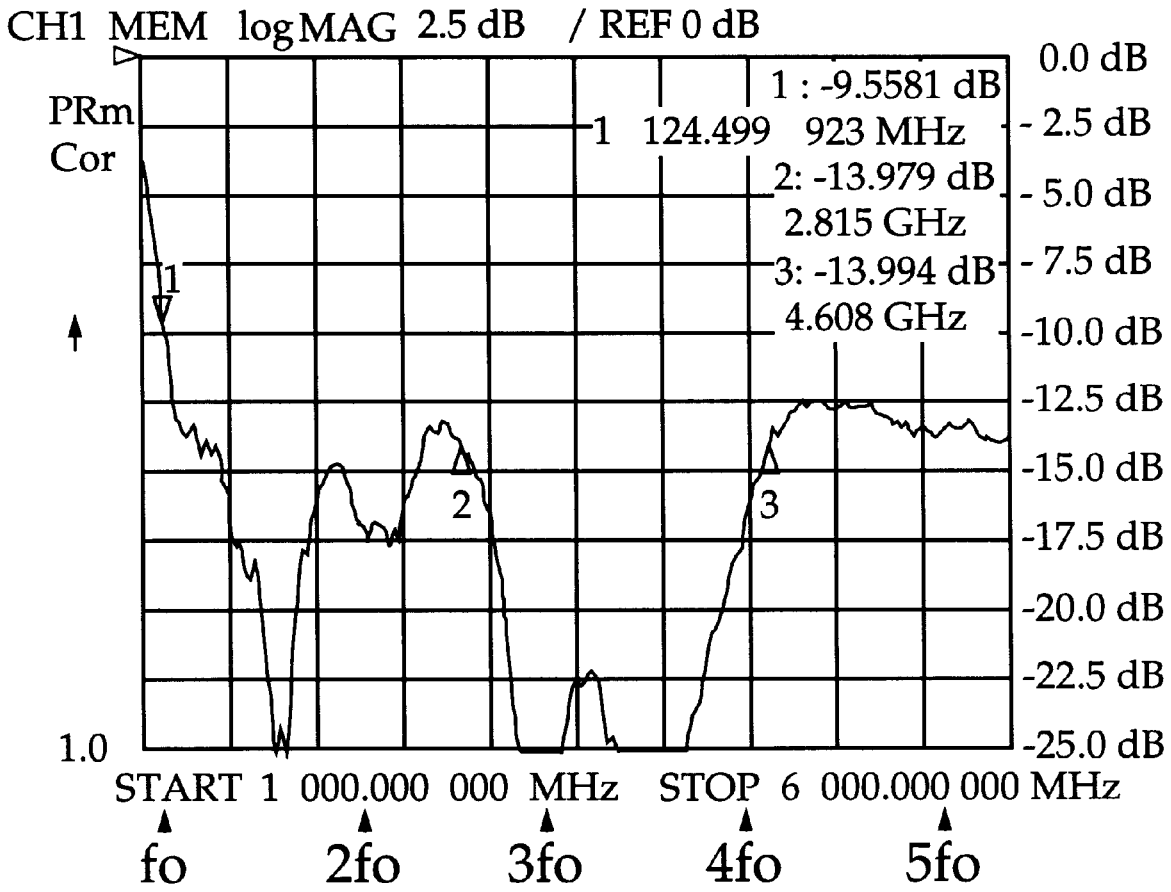
FIG. 6 is a plot of measured return loss of a fixed-radius tapered slot antenna with conventional feed, as shown in FIG. 3.

The return loss of one of the fixed-radius tapered slot antenna having a conventional microstrip feed has been measured. The antenna is fabricated on a substrate having a thickness of about 0.030" with a dielectric constant of about 3.0. The radius of the hemispherical shaped elements 12, 13 is about 0.87", and Y is about 3.5". The width of the slotline around the balun 18 is about 0.05". The results are shown in FIG. 6.

Figure 4:
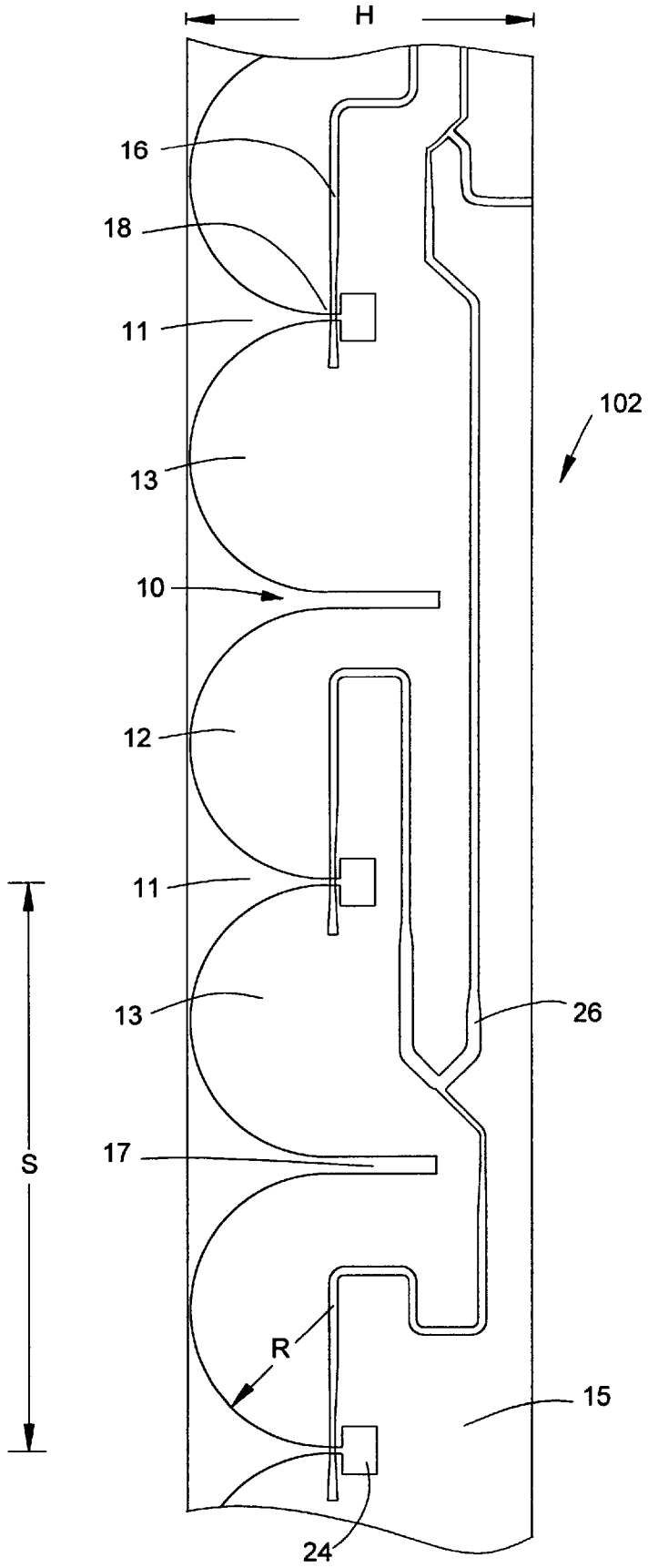
FIG. 4 illustrates an array of fixed-radius tapered slot antennas with integrated microstrip feed circuit.

FIG. 4 illustrates a section of a fixed-radius tapered slot antenna array. As shown in FIG. 4, The antenna array 102 comprises a number of fixed-radius tapered slot antennas contiguously formed on a narrow strip of dielectric substrate 10. All these slots are etched out from a continuous metallized layer on one side of the substrate. On the other side of the substrate, a microstrip feed network, or power divider network, 26 is formed to provide a balun 18 to each slotline. The extended portion 15 behind the slot antennas form a continuous ground plane for the microstrip power divider network. It should be noted that the slotline of each slot antenna is terminated by an open-circuit in the form of rectangular slot 24. But the slotline can be terminated differently. If the radius R of the hemispherical shaped members 12, 13 is chosen to be one eighth of the longest operating wavelength of the antenna, then the spacing, S, between two antenna elements, that is, the spacing between two adjacent tapered slots is substantially equal to one half of the longest operating wavelength. However, this spacing can be smaller or greater than one half of the longest operating wavelength and the spacing can be constant throughout the array or vary from one section of the array to another. It should be noted that, in order to avoid having the undesirable grating lobes in the radiation patterns, the spacing S is usually smaller than one longest operating wavelength.

In FIG. 4, the gap 17 separating two adjacent slot antenna elements has a rectangular extended portion in the common base 15. The shape and the dimensions of the gap can affect the performance of the antenna array 102. Depending on the specific requirements of the antenna array, gap 17 may have a different shape and/or different dimensions. However, it is preferred that the impedance of the slotline 11 is between 70 and 80 ohms.

An array having five antenna elements with a microstrip feed network has been fabricated on a substrate having a thickness between 0.030" and 0.032" with a dielectric constant between 3.0 and 3.38. The radius of the hemispherical shaped elements 12, 13 is about 1.1". The length of a single antenna element is about 4.5" and the height, H, is about 2.7". The width of gap 17 is about 0.25" and the depth measured from the edge of the substrate is about 2". It should be noted that the dimensions of gap 17 may be used as a tuning mechanism to improve either the isolation between adjacent antenna elements or the return loss of the array. It is preferable to have as low an isolation as possible. It should be noted, however, that the dimensions of the gap that yield the optimal isolation may not necessarily yield the optimal return loss performance.

Figure 5:
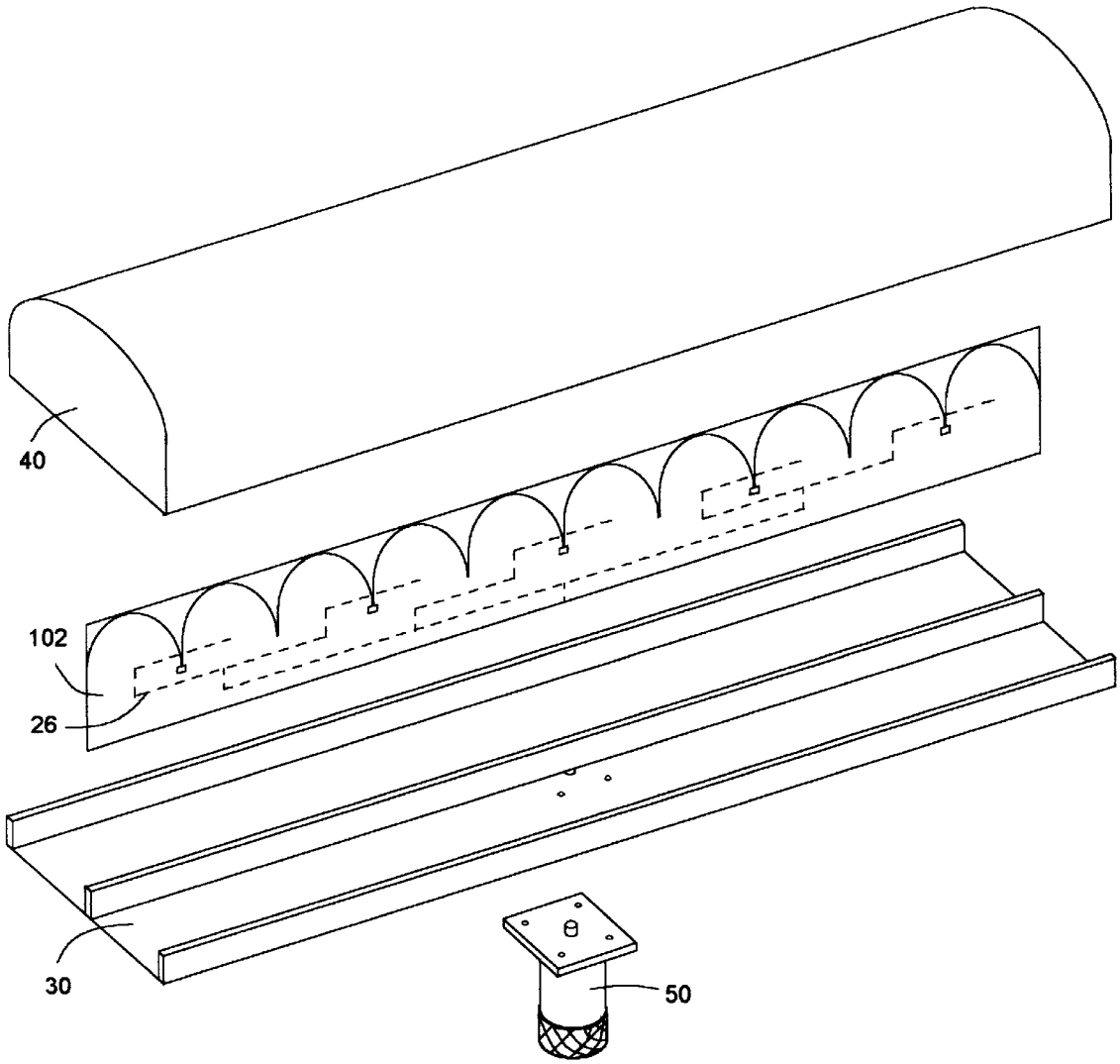
FIG. 5 is an exploded isometric view of an array of fixed-radius tapered slot antennas with a reflector and a radome.
Figure 8:
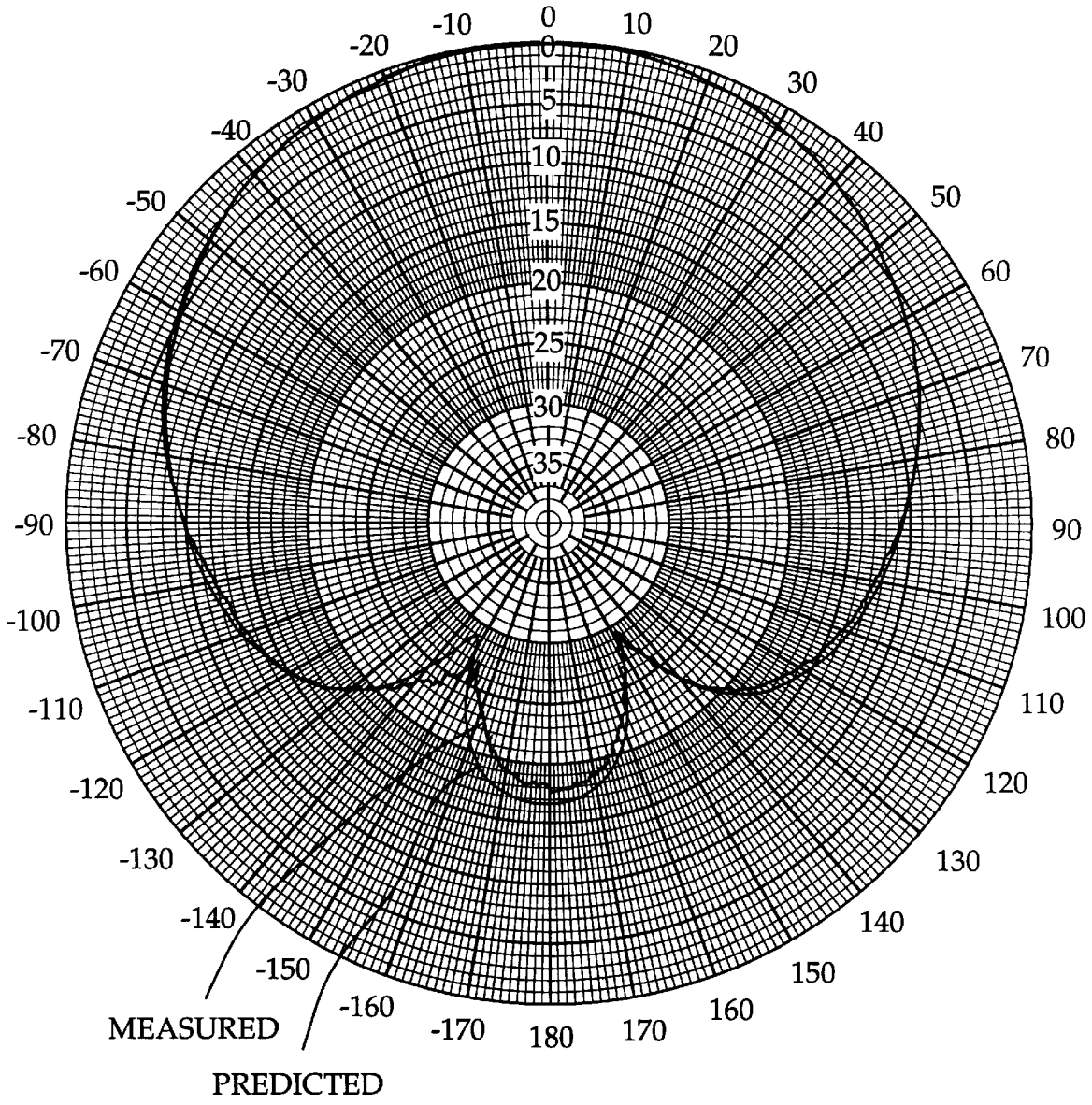
FIG. 8 is a plot of measured and predicted radiation azimuth patterns of a fixed-radius tapered slot antenna element with a reflector.
Figure 9:
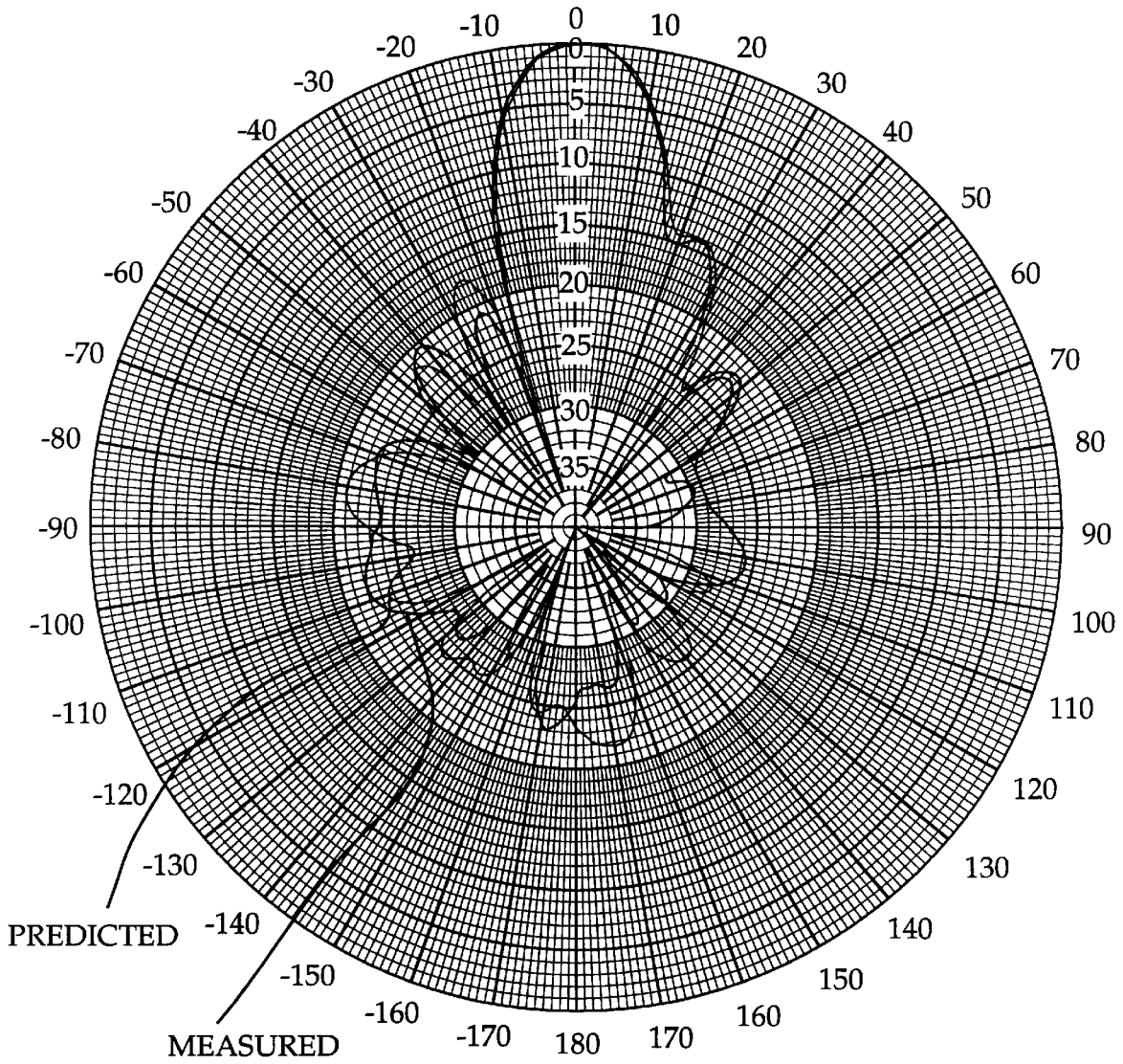
FIG. 9 is a plot of measured and predicted radiation patterns of an array of fixed-radius tapered slot antenna with a reflector as shown in FIG. 4 and FIG. 5.

The above-described array is further integrated with a reflector as shown in FIG. 5. The plot showing the measured radiation patterns of the array integrated with a 24×5.5" reflector with 0.8" lips is shown in FIG. 9. The measured radiation patterns of a single antenna element (taken from a similar array) with the same reflector are shown in FIG. 7 and FIG. 8.

FIG. 5 depicts an array of fixed-radius slot antennas integrated with a reflector and a radome. As shown in FIG. 5, an electrically conductive reflector 30 is integrated with antenna array 102 to improve the radiation performance. The reflector plane is substantially perpendicular to the metallized layer of the antenna array and properly extends along the entire length of the array. It is preferred that a lip is formed on each side of the reflector as shown. Preferably, a radome 40 is used to cover the antenna array and the reflector. A connector 50 is connected to the array to provide power to the microstrip power divider network 26.

Figure 2:
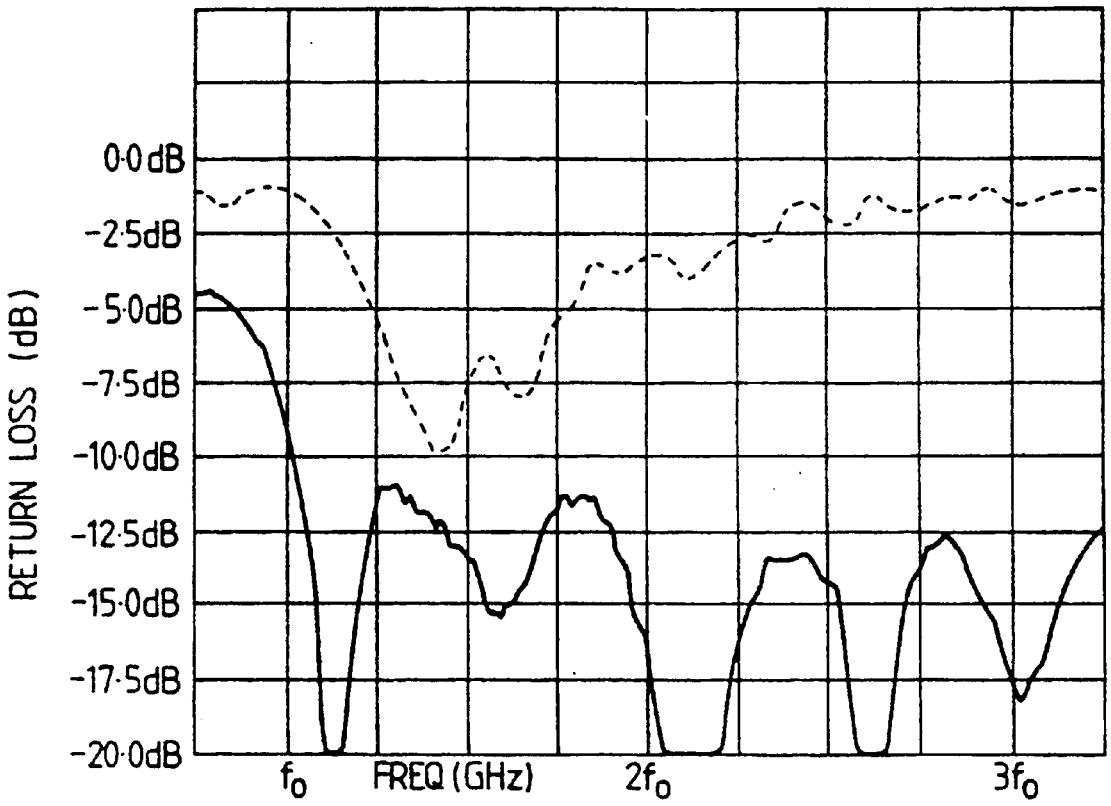
FIG. 2 is a plot of measured return loss of a prior art Vivaldi antenna with conventional and improved feed.

FIG. 6 is a plot of measured return loss of a single fixed-radius tapered slot antenna with conventional feed. In comparison to the Vivaldi slot antenna shown in FIG. 1, the return loss performance of the fixed-radius tapered slot antenna with conventional feed is significantly better than the Vivaldi antenna with conventional feed (dotted-line, FIG. 2), and it is also better than the Vivaldi antenna with an improved feed (solid line, FIG. 2).

Figure 7:
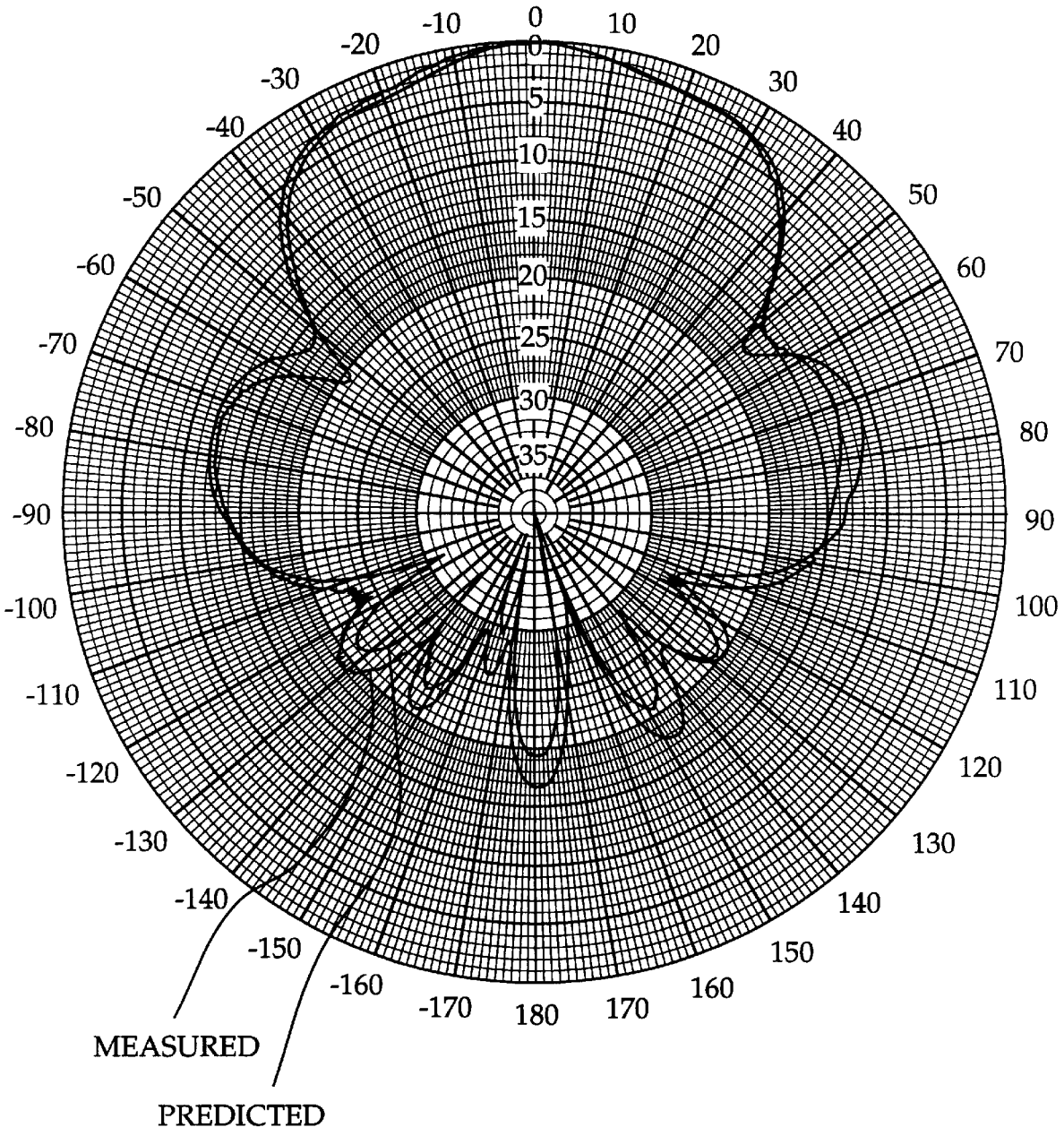
FIG. 7 is a plot of measured and predicted radiation elevation patterns of a fixed-radius tapered slot antenna element with a reflector.

FIG. 7 is a plot of measured and predicted radiation elevation patterns of a fixed-radius tapered slot antenna. As shown in FIG. 7, the measured radiation patterns match closely with the predicted patterns derived from existing antenna modeling computer programs. This fact demonstrates that the performance of the fixed-radius taper is highly predictable in all directions.

This predictability is particularly important when optimizing low front to back ratios in the design process.

FIG. 8 is a plot of measured and predicted radiation azimuth patterns of a fixed-radius tapered slot antenna. Again, the predicted and measured results are in excellent agreement.

FIG. 9 is a plot of measured and predicted radiation patterns of an array of fixed-radius tapered slot antenna.

While the present invention has been described in accordance with the preferred embodiments and the drawings are for illustrative purposes only, it is intended that it be limited in scope only by the appended claims.

What is claimed is:

1. A broadband tapered slot antenna arrangement comprising:

(a) at least one antenna element including an insulating substrate with an electrically conductive layer on one side thereof, said layer having formed therein a tapered slot formed by adjacent hemispherical shaped members, each extending outward from a common base of said conductive layer, and having a balun formed adjacent said base in proximity to the hemispherical shaped members; and (b) a feedline electromagnetically coupled to the balun.

2. The slot antenna arrangement of claim 1 wherein the feedline is formed on another side of the insulating substrate, opposite to the tapered slot.

3. The slot antenna arrangement of claim 1 further comprising an electrically conductive reflector in the proximity of said at least one antenna element adjacent said common base.

4. The slot antenna arrangement of claim 1 further comprising a radome covering over said at least one antenna element.

5. An antenna array comprising:

a plurality of coplanar antenna elements formed on one side of a dielectric substrate having thereon an electrically conductive layer, wherein each antenna element comprises a tapered slot defined by adjacent conductive elements each having a fixed radius of curvature;

an electrically conductive network formed on the other side of the dielectric substrate opposite to the conductive elements for providing a plurality of feedlines for electromagnetically coupling each tapered slot to a feedline at a balun.

6. The antenna array of claim 5 wherein the radius of curvature of the conductive elements is substantially equal to one eighth of the lowest operating frequency of the antenna array.

7. The antenna array of claim 5 wherein the radius of curvature is greater than one eighth of the lowest operating frequency.

8. The antenna array of claim 5 wherein the radius of curvature is smaller than one eighth of the lowest operating frequency.

9. The antenna array of claim 5 wherein the spacing between two adjacent tapered slots is substantially equal to one half of the lowest operating frequency of the antenna array.

10. The antenna array of claim 5 wherein the spacing between two adjacent tapered slots is greater than one half of the lowest operating frequency of the antenna array.

11. The antenna array of claim 5 wherein the spacing between two adjacent tapered slots is smaller than one half of the lowest operating frequency of the antenna array.

12. The antenna array of claim 5 wherein the spacing between two adjacent tapered slots is substantially uniform throughout the antenna array.

13. The antenna array of claim 5 wherein at least one spacing between two adjacent tapered slots is greater than the other spacings.

14. The antenna array of claim 5 wherein at least one spacing between two adjacent tapered slots is smaller than at least one other spacing.

15. An antenna configuration to be used in a slot antenna element formed on an electrically conductive layer attached to an insulating substrate comprising two hemispherical shaped members formed on said conductive layer for defining a tapered slot having a fixed radius of curvature along the boundaries of the slot, said hemispherical shaped members each extending outward from a common base of said conductive layer.

* * * * *